US008951013B2

(12) United States Patent
Miller et al.

(10) Patent No.: US 8,951,013 B2
(45) Date of Patent: Feb. 10, 2015

(54) TURBINE BLADE RAIL DAMPER

(75) Inventors: Jeff H. Miller, Simi Valley, CA (US); Steven P. Grota, Thousand Oaks, CA (US)

(73) Assignee: United Technologies Corporation, Hartford, CT (US)

( * ) Notice: Subject to any disclaimer, the term of this patent is extended or adjusted under 35 U.S.C. 154(b) by 540 days.

(21) Appl. No.: 13/279,473

(22) Filed: Oct. 24, 2011

(65) Prior Publication Data

US 2013/0101395 A1 Apr. 25, 2013

(51) Int. Cl.
*F01D 5/16* (2006.01)
*F01D 5/22* (2006.01)
*F01D 25/06* (2006.01)

(52) U.S. Cl.
CPC *F01D 5/16* (2013.01); *F01D 5/225* (2013.01); *F01D 25/06* (2013.01); *F05D 2260/96* (2013.01); *Y10S 416/50* (2013.01)
USPC ..... 416/190; 416/500

(58) Field of Classification Search
CPC ..... F01D 5/16; F01D 5/225; F01D 5/24; F01D 5/22; F01D 25/06; F05B 2260/96; F05B 2260/964; F05D 2260/96
USPC ..... 415/119; 416/190–192, 193 A, 500
See application file for complete search history.

(56) References Cited

U.S. PATENT DOCUMENTS

| | | | | |
|---|---|---|---|---|
| 2,610,823 | A | 9/1952 | Knowlton, Jr. | |
| 3,752,599 | A * | 8/1973 | Pace | 416/190 |
| 3,986,792 | A | 10/1976 | Warner | |
| 4,111,603 | A * | 9/1978 | Stahl | 416/95 |
| 4,177,011 | A | 12/1979 | Eskesen et al. | |
| 4,767,273 | A | 8/1988 | Partington | |
| 4,897,021 | A * | 1/1990 | Chaplin et al. | 415/173.7 |
| 4,936,749 | A * | 6/1990 | Arrao et al. | 416/193 A |
| 5,083,903 | A | 1/1992 | Erdmann | |
| 5,423,659 | A * | 6/1995 | Thompson | 415/173.1 |
| 5,730,584 | A * | 3/1998 | Dodd | 416/190 |
| 6,343,912 | B1 | 2/2002 | Manteiga et al. | |
| 6,371,727 | B1 | 4/2002 | Stangeland et al. | |
| 2005/0135936 | A1 * | 6/2005 | Cherolis et al. | 416/193 A |
| 2008/0050236 | A1 * | 2/2008 | Allen | 416/190 |
| 2013/0170994 | A1 * | 7/2013 | Jones | 416/189 |

* cited by examiner

*Primary Examiner* — Ned Landrum
*Assistant Examiner* — Brian P Wolcott
(74) *Attorney, Agent, or Firm* — Kinney & Lange, P.A.

(57) ABSTRACT

A device for damping of vibratory energy in the blades of rotor assemblies during operation where the blades have a shroud attached thereto with at least one sealing rail extending radially outward from the shroud to an outer diameter surface. A damper element is attached to the turbine blade sealing rail extending radially inward from the rail outer diameter surface along rail sides to maintain the damper element out of the flow of gas and positioned at a radial location on the blade for damping.

12 Claims, 8 Drawing Sheets

TURBINE BLADE RAIL DAMPER

BACKGROUND

This invention relates to rotor blades and specifically to the mechanical damping of vibratory energy in the blades of rotor assemblies during operation. Rotor assemblies are used in a variety of turbo-machines, such as turbines and compressors. During operation, fluid forces induce vibratory stresses on the blades, resulting in high cycle fatigue and potential failure of the blades. Dampers, commonly frictional dampers, are utilized to reduce the magnitude of these dynamic stresses, thereby increasing operational life of the blades.

Typically the most effective frictional dampers are located on the turbine blade shroud. The shroud is located at the radial tip of the rotor blade adjacent the stationary housing. During operation, centrifugal forces urge the damper into frictional contact with its adjacent blade shroud. This contact reduces the relative motion between the adjacent blades, thereby reducing the vibratory stresses on the blades during operation. Frictional damping is effective so long as relative motion exists between the damper and the blade. When the rotor speed becomes high, typical flat plate shroud dampers become too heavy and the frictional damper sticks to the shroud due to friction thereby reducing its effectiveness. Typical lighter weight damper designs consist of loss fitting rivets. These rivets are hard to form due to the many tight tolerance features required and they are exposed to the main gas flow.

Other efforts to reduce vibrational damage not only are structurally deficient in affecting the clearances of the shroud, they are subject to fatigue that further reduces their effectiveness.

Conventional shrouds typically include one or more sealing rails that extend radially outward from the shroud in close proximity to the stationary housing and typically extend continuously across the top surface of the shroud between first and second circumferential sides. Typical previous shroud frictional dampers are retained by extra features added to the shroud. These added features are located on the shroud at the furthest distance from blade which increases the shroud overhung weight. These added features increase the centrifugal induced bending stress in the shroud which may result in potential failure of the rotor assembly due to high cycle fatigue. To counteract this, the shroud thickness must be increased. This increase in shroud thickness also results in higher centrifugal stress in the blade at the blade's two critical locations, the blade shank and firtree.

What is needed is a way to place any damper out of the main gas flow of turbo-machines without adversely affecting the function of the shroud.

SUMMARY

The present invention relates to a damper arrangement on the sealing rail of turbo-machine shrouds where the damper in the rail is outside of the main gas flow. This invention uses the existing rail and requires no modification to the shroud to retain the damper. The rail damper comprises a shim stock having its ends oriented to function with specific shroud rail configurations. The present invention does not require any special retainment features. Retainment features add weight to the shroud and result in lower shroud and blade safety factors.

DETAILED DESCRIPTION

Figure 1:
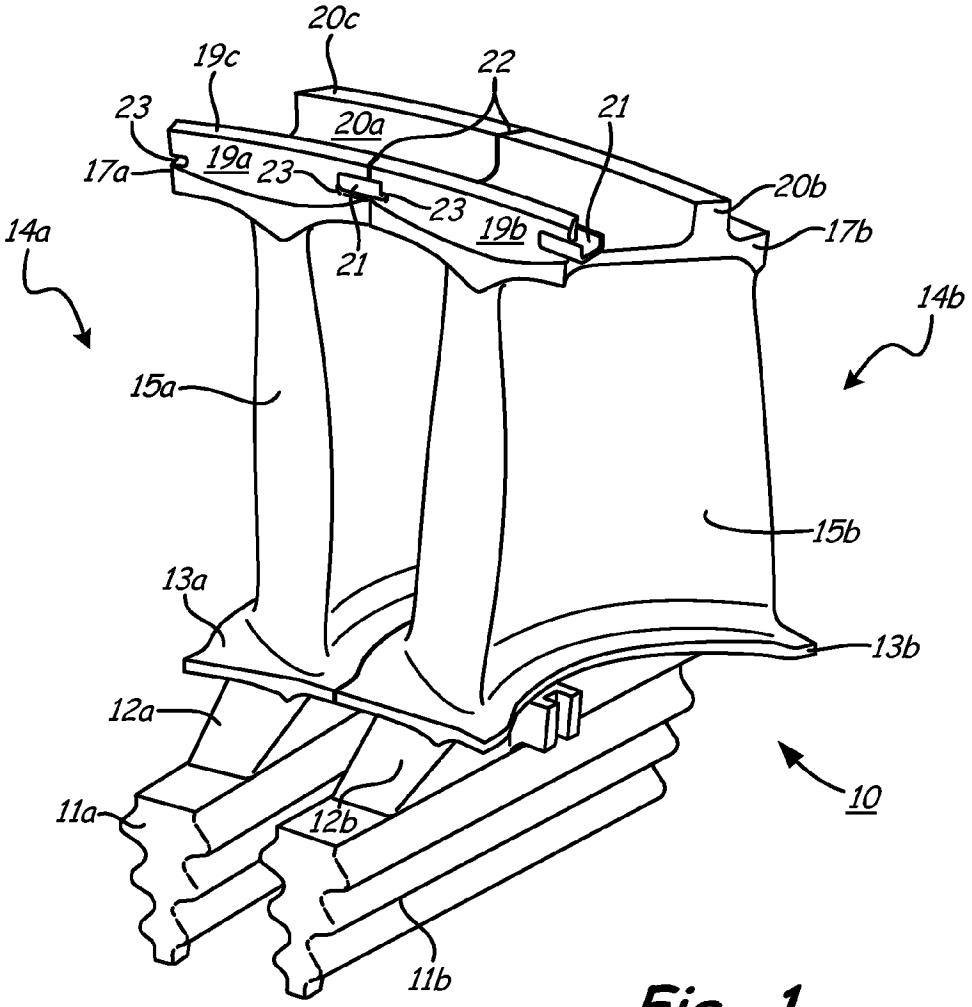
FIG. 1 is a perspective view illustrating one embodiment of the present invention in a rotor assembly used in turbo-machines, showing turbine blades having shrouds with rails and damper elements.

FIG. 1 shows a perspective view of an assembly 10, generally, of a pair of turbine blades 14*a* and 14*b* of a turbo-machine such as a gas turbine engine. Blades 14*a* and 14*b* include firtrees 11*a* and 11*b*, blade shanks 12*a* and 12*b*, platforms 13*a* and 13*b*, airfoils 15*a* and 15*b*, shrouds 17*a* and 17*b*, upstream rails 19*a* and 19*b*, and downstream rails 20*a* and 20*b*, respectively. Airfoils 15*a* and 15*b* extend radially out from platforms 13*a* and 13*b* to shrouds 17*a* and 17*b*. Shrouds 17*a* and 17*b* include upstream rails 19*a* and 19*b* and downstream rails 20*a* and 20*b*, which extend radially outward in close proximity to a stationary housing (of conventional design, not shown). Upstream rails 19*a* and 19*b* and downstream rails 20*a* and 20*b* typically extend continuously across the top surface of shrouds 17*a* and 17*b* between first and second radial faces. Rail damper 21 is placed on upstream rails 19*a* and 19*b* at a point remote from the main gas flow in the turbo-machine. Damper 21 is radially inward from the outer surface 19*c* of the upstream rail 19*a*. Damper 21 is shown bridging the gap between successive upstream rail portions of 19*a* and 19*b* at junction 22.

FIG. 1 shows two blades 14*a* and 14*b* to illustrate the positioning of damper 21 at junction 22. Also shown is another damper 21 at the right end of rail 19*b* for positioning between rail 19*b* and a corresponding upstream rail of a blade that will be positioned adjacent blade 19*b*.

Damper element 21 may be any shape that provides a fit on the rail, with a generally "U" shape being shown. The sides of the "U" shape may extend radially up or down, depending on the configuration of upstream rails 19*a* and 19*b*. The use of the "U" shape allows for simple manufacture and installation. Damper 21 may be any material, such as steel or other metals, ceramics and other materials. Damper 21 material should be selected to have a light weight when possible.

Figure 2C:
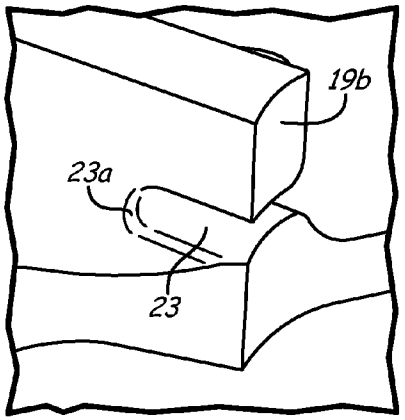
FIG. 2*c* is an enlarged perspective view of the slot in the shroud and rail in FIG. 2*a*.
Figure 2D:
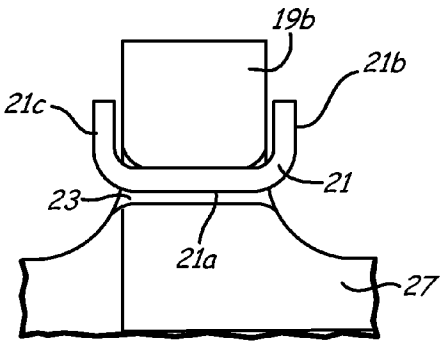
FIG. 2*d* is an end view of the damper in the slot of FIG. 2*c*.
Figure 2A:
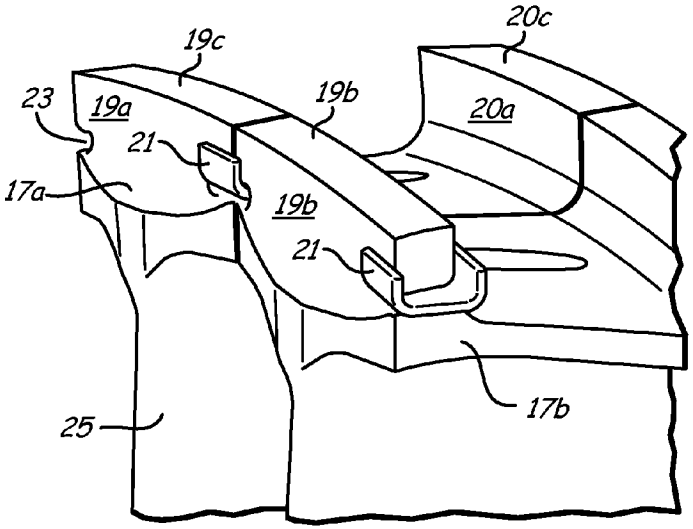
FIG. 2*a* is a perspective view of the embodiment in a shroud rail.
Figure 2B:
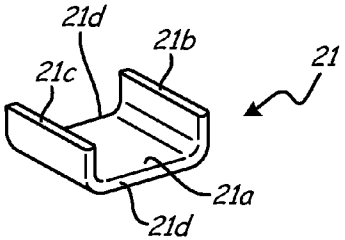
FIG. 2*b* is an enlarged perspective view of the damper used in FIG. 1.

FIG. 2*a* is an enlarged perspective view showing the details of the relationship between shrouds 17*a* and 17*b* and upstream rails 19*a* and 19*b*. Damper 21 is seen in FIG. 2*b* as having fully rounded end faces 21*d*, a flat center portion 21*a*, and side portions 21*b* and 21*c*. FIG. 2*c* shows damper slot 23 with a fully rounded end face 23*a* to accept and hold damper 21. FIG. 2*d* shows damper 21 in slot 23 in the operating position where side portions 21*b* and 21*c* extend up to engage upstream rail 19*b*.

Figure 3C:
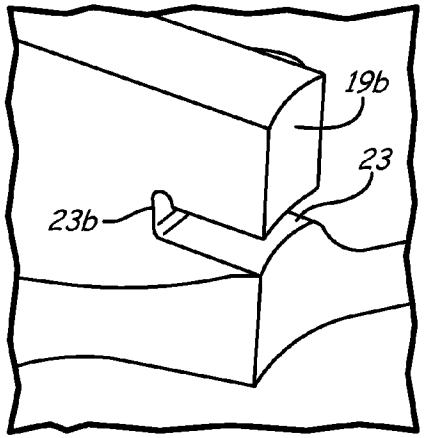
FIG. 3*c* is an enlarged perspective view of the slot in the shroud and rail in FIG. 3*a*.
Figure 3D:
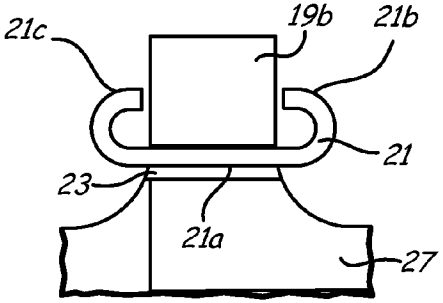
FIG. 3*d* is an end view of the damper in the slot of FIG. 3*c*.
Figure 3A:
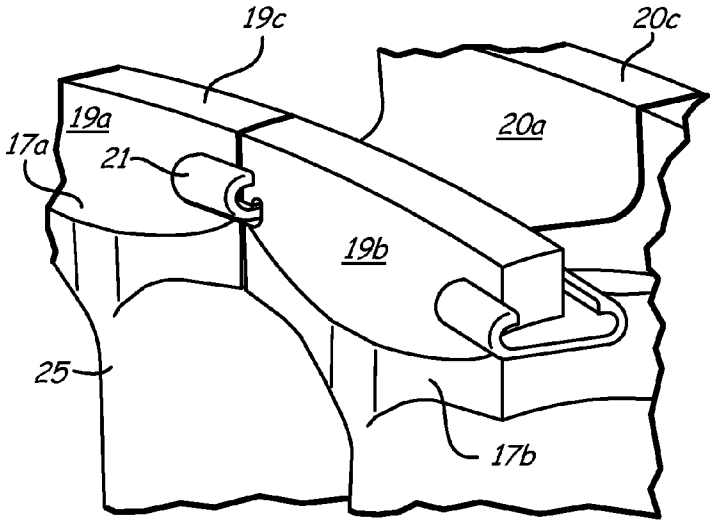
FIG. 3*a* perspective view of another embodiment of this invention in a shroud rail.
Figure 3B:
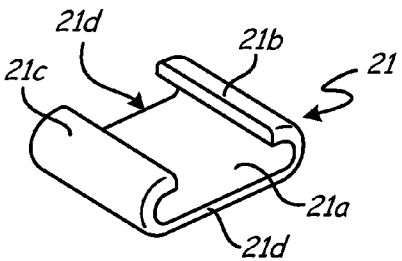
FIG. 3*b* is an enlarged perspective view of the damper used in FIG. 3*a*.

FIG. 3*a* is an enlarged perspective view showing the details of an alternative relationship between shrouds 17*a* and 17*b* and upstream rails 19*a* and 19*b*. Damper 21 is seen in FIG. 3*b* as having fully rounded end faces 21*d*, a flat center portion 21*a*, and c shaped side portions 21*b* and 21*c*. FIG. 3*c* shows damper slot 23 with an undercut end face 23*b* to accept and hold damper 21. FIG. 3*d* shows damper 21 in slot 23 in the operating position where side portions 21*b* and 21*c* engage upstream rail 19*b*.

Figure 4C:
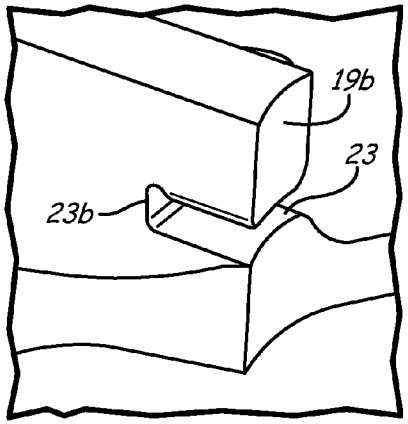
FIG. 4*c* is an enlarged perspective view of the slot in the shroud and rail in FIG. 4*a*.
Figure 4D:
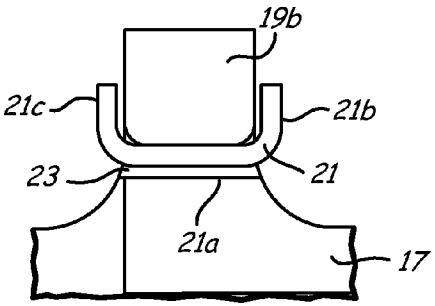
FIG. 4*d* is an end view of the damper in the slot of FIG. 4*c*.
Figure 4A:
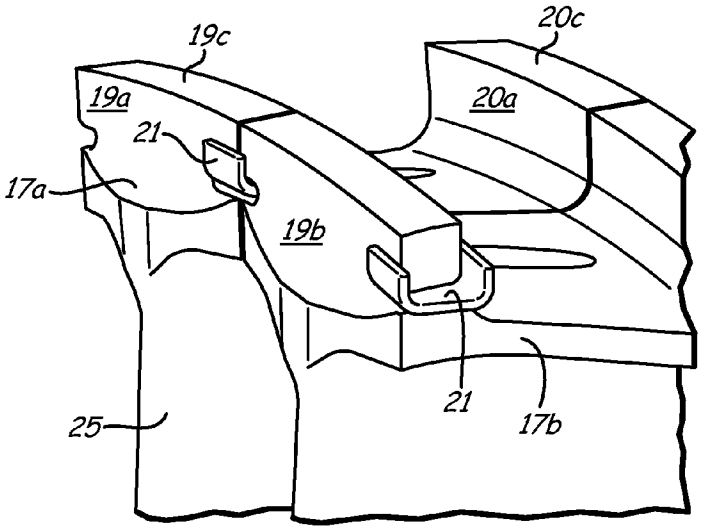
FIG. 4*a* perspective view of another embodiment of this invention in a shroud rail.
Figure 4B:
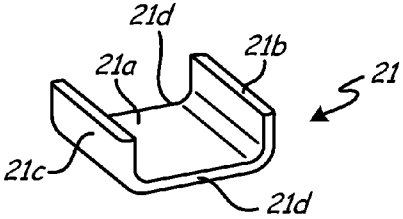
FIG. 4*b* is an enlarged perspective view of the damper used in FIG. 4*a*.

FIG. 4*a* is an enlarged perspective view showing the details of another alternative relationship between shrouds 17*a* and 17*b* and upstream rails 19*a* and 19*b*. Damper 21 is seen in FIG. 4*b* as having fully rounded end faces 21*d*, a flat center portion 21*a*, and side portions 21*b* and 21*c*. FIG. 4*c* shows damper slot 23 with an undercut end face 23*b* to accept and hold damper 21. FIG. 4*d* shows damper 21 in slot 23 in the operating position where side portions 21*b* and 21*c* engage upstream rail 19*b*.

Figure 5C:
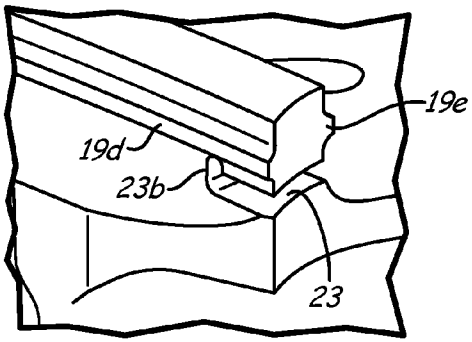
FIG. 5*c* is an enlarged perspective view of the slot in the shroud and rail in FIG. 5*a*.
Figure 5D:
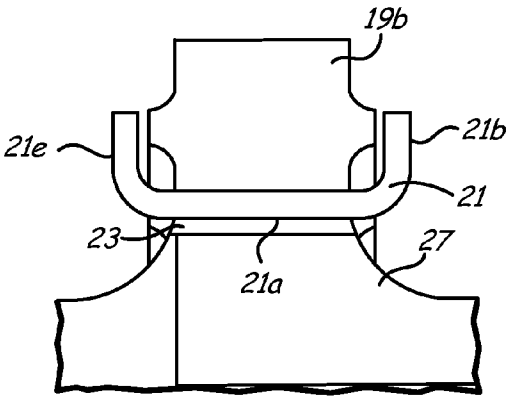
FIG. 5*d* is an end view of the damper in the slot of FIG. 5*c*.
Figure 5A:
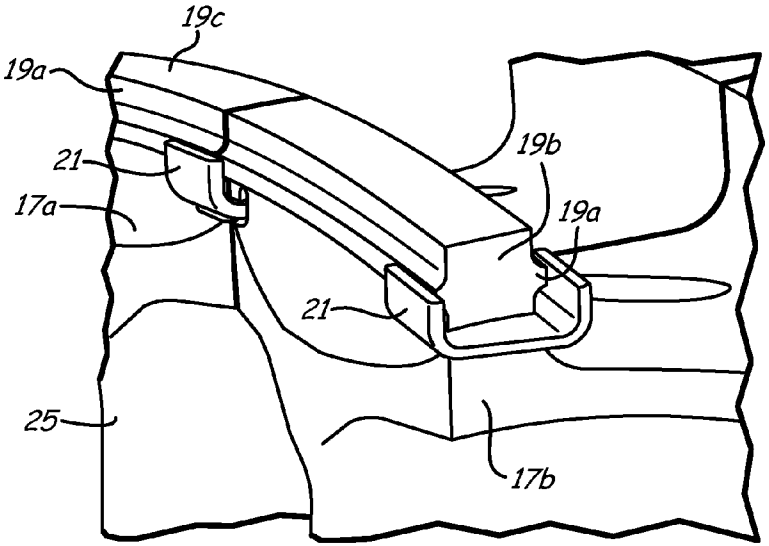
FIG. 5*a* perspective view of another embodiment of this invention in a shroud rail.
Figure 5B:
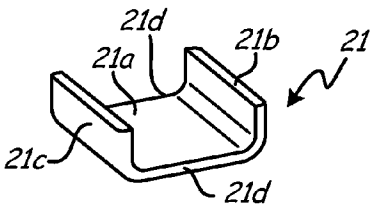
FIG. 5*b* is an enlarged perspective view of the damper used in FIG. 5*a*.

FIG. 5*a* is an enlarged perspective view showing the details of another alternative relationship between shrouds 17*a* and 17*b* and upstream rails 19*a* and 19*b*. Damper 21 is seen in FIG. 5*b* as having fully rounded end faces 21*d*, a flat center portion 21*a*, and side portions 21*b* and 21*c* having a size suitable to engage axial stops 19*d* and 19*e*. FIG. 5*c* shows damper slot 23 with an undercut end face 23*b* to accept and hold damper 21. FIG. 5*d* shows damper 21 in slot 23 in the operating position.

Figure 6C:
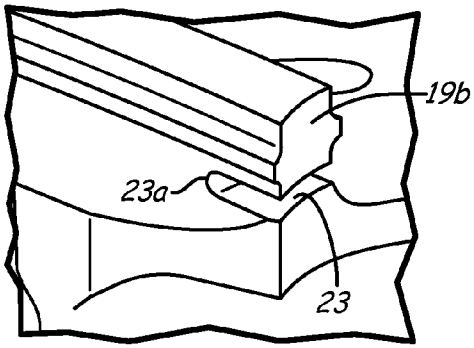
FIG. 6*c* is an enlarged perspective view of the slot in the shroud and rail in FIG. 6*a*.
Figure 6D:
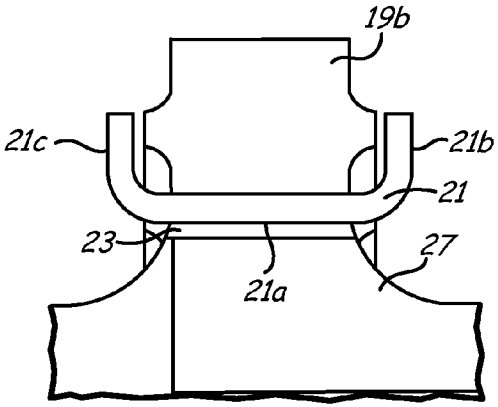
FIG. 6*d* is an end view of the damper in the slot of FIG. 6*c*.
Figure 6A:
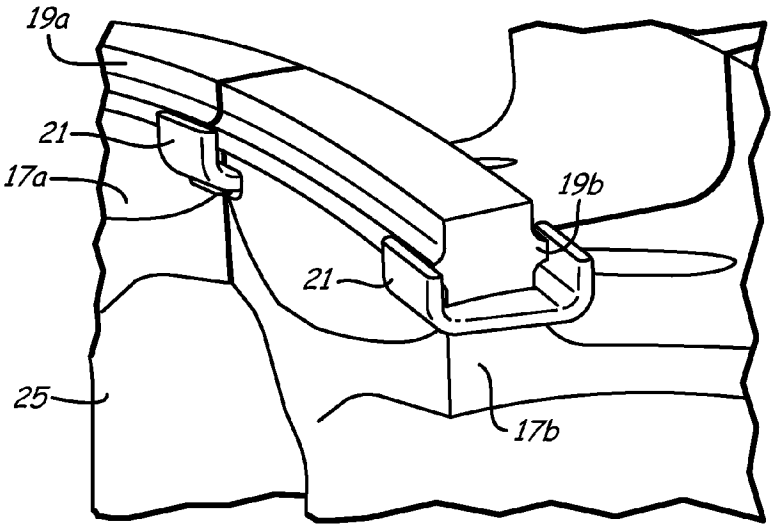
FIG. 6*a* perspective view of another embodiment of this invention in a shroud rail.
Figure 6B:
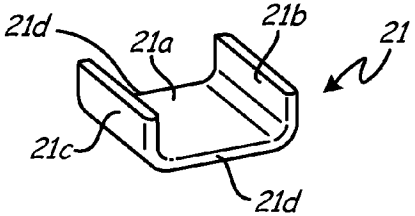
FIG. 6*b* is an enlarged perspective view of the damper used in FIG. 6*a*.

FIG. 6*a* is an enlarged perspective view showing the details of another alternative relationship between shrouds 17*a* and 17*b* and upstream rails 19*a* and 19*b*. Damper 21 is seen in FIG. 6*b* as having fully rounded end faces 21*d*, a flat center portion 21*a* and both ends 21*b* and 21*c*. FIG. 6*c* shows damper slot 23 with a round end face 23*a* to accept and hold damper 21. FIG. 6*d* shows damper 21 in slot 23 in the operating position where damper ends 21*b* and 21*c* engage upstream rail 19*b*.

Figure 7C:
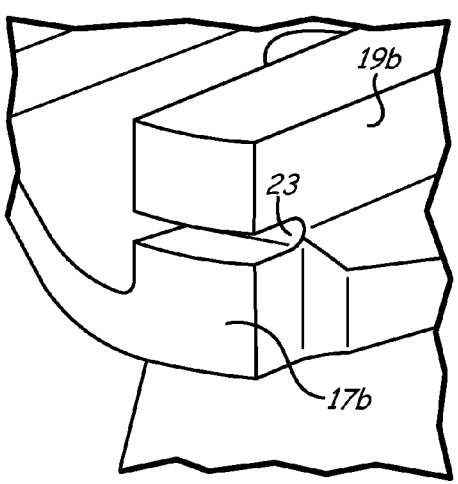
FIG. 7*c* is an enlarged perspective view of the slot in the shroud and rail in FIG. 7*a*.
Figure 7D:
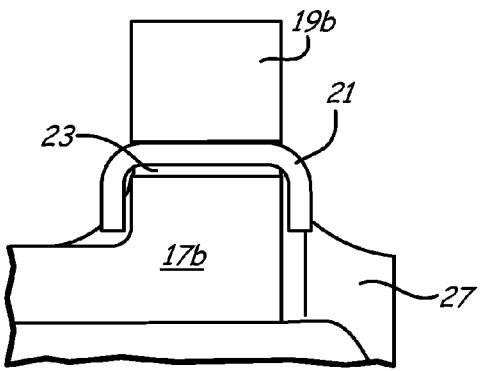
FIG. 7*d* is an end view of the damper in the slot of FIG. 7*c*.
Figure 7A:
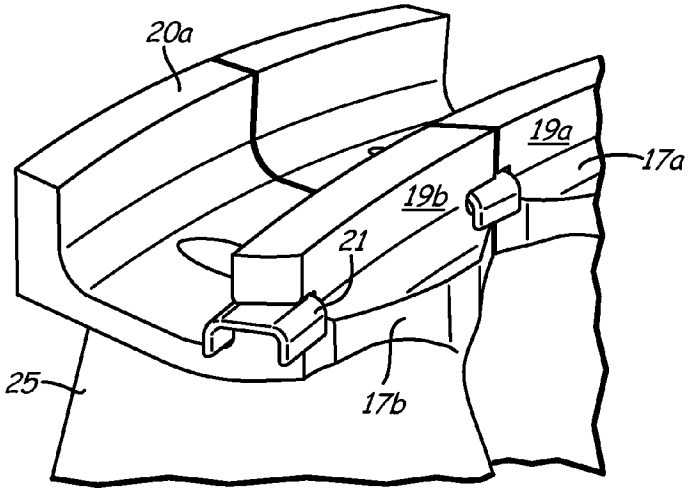
FIG. 7*a* perspective view of another embodiment of this invention in a shroud rail.
Figure 7B:
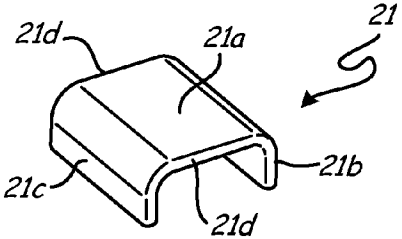
FIG. 7*b* is an enlarged perspective view of the damper used in FIG. 7*a*.

FIG. 7*a* is an enlarged perspective view showing the details of another alternative relationship between shrouds 17*a* and 17*b* and upstream rails 19*a* and 19*b*. Damper 21 is seen in FIG. 7*b* as having fully rounded end faces 21*d*, a flat center portion 21*a*, and side portions 21*b* and 21*c*. FIG. 7*c* shows damper slot 23 with a fully rounded end face where portions of shroud 17*a* and 17*b* are relieved to accept and hold side portions 21*b* and 21*c*. FIG. 7*d* shows damper 21 in slot 23 in the operating position where side portions 21*b* and 21*c* extend downward to engage upstream rail 19*b*.

Figure 8C:
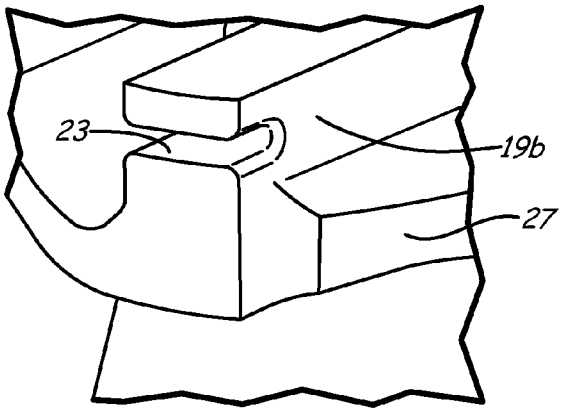
FIG. 8*c* is an enlarged perspective view of the slot in the shroud and rail in FIG. 8*a*.
Figure 8D:
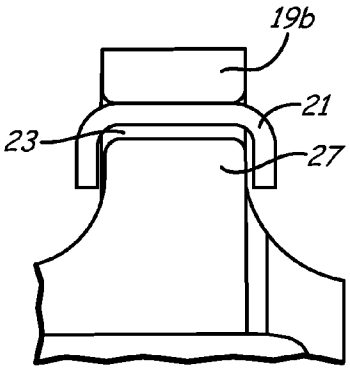
FIG. 8*d* is an end view of the damper in the slot of FIG. 68*c*.
Figure 8A:
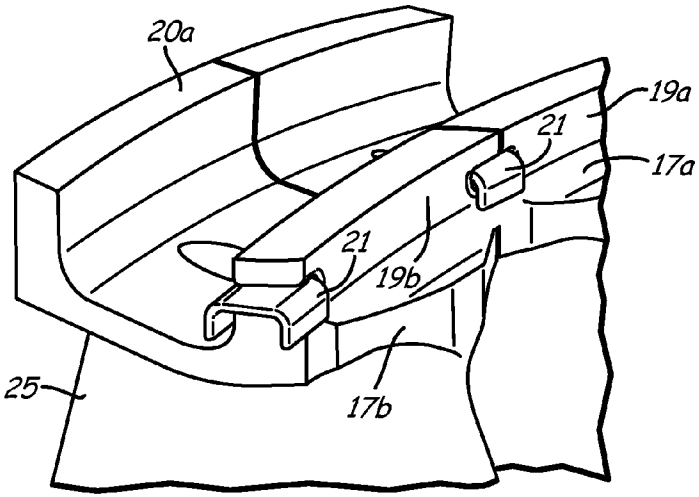
FIG. 8*a* perspective view of another embodiment of this invention in a shroud rail.
Figure 8B:
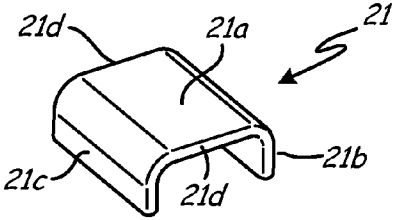
FIG. 8*b* is an enlarged perspective view of the damper used in FIG. 8*a*.

FIG. 8*a* is an enlarged perspective view showing the details of another alternative relationship between shrouds 17*a* and 17*b* and upstream rails 19*a* and 19*b*. Damper 21 is seen in FIG. 8*b* as having fully rounded end faces, a flat center portion 21*a*, and side portions 21*b* and 21*c*. FIG. 8*c* shows damper slot 23 wider to accept and hold side portions 21*b* and 21*c* without having any part of shrouds 17*a* and 17*b* being removed. FIG. 8*d* shows damper 21 in slot 23 in the operating position where side portions 21*b* and 21*c* extend downward to engage upstream rail 19*b*.

In all of the embodiments shown herein, the damper is designed to engage the sealing rail of a shroud facing inward from the rail outer surface to maintain the damper element out of the flow of gas and at the most effective radial location on the blade. Damping is affected without any lessening of the functionality of the rails or the shroud. Similar dampers may also be placed on downstream rails since alteration of the shroud is not needed.

The invention has been shown in association with a firtree bladed rotor. The invention is also suitable for use with other rotor configurations such as an integrally bladed rotor, for example.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A rotor for use with a turbine having a plurality of blades extending radially outward, comprising:

a plurality of shrouds, each shroud being positioned radially outward of and attached to one of the blades;

a plurality of sealing rails, each sealing rail extending radially outward from each shroud, each sealing rail having a slot at each radial face of the sealing rail, wherein each slot is generally perpendicular to a corresponding radial face of the sealing rail, and wherein each slot extends from an upstream face to a downstream face of the sealing rail; and a plurality of damper elements, each damper element being positioned in and extending between adjacent slots of opposing radial faces of adjacent sealing rails.

2. The rotor of claim 1, wherein the damper element is made from metal or ceramic.

3. The rotor of claim 1, wherein the sealing rail further includes an axial stop on the upstream or downstream face of the sealing rail for engaging the damper element.

4. The rotor of claim 1, wherein the damper element is generally "U" shaped, and wherein the "U" has a flat center portion that engages an end face of the slot, and wherein the "U" has a side portion that extends along the upstream or downstream face of the sealing rail.

5. The rotor of claim 4, wherein the side portion of the "U" extends radially outward on the upstream or downstream face of the sealing rail.

6. The rotor of claim 4, wherein the side portion of the "U" extends radially inward on the upstream or downstream face of the sealing rail.

7. The rotor of claim 1, wherein one of the slots is undercut at an end face of the slot to further engage the damper element.

8. A rotor for use with a turbine, the rotor comprising:

a plurality of blades extending radially outward, each blade having a shroud positioned at a radially outward end of the blade and containing a sealing rail, each sealing rail having a slot at each radial face of the sealing rail, wherein each slot is generally perpendicular to a corresponding radial face of the sealing rail, and wherein each slot extends from an upstream face to a downstream face of the sealing rail; and a plurality of damper elements made from metal or ceramic, each damper element engaging opposing slots of adjacent sealing rails, each damper element being generally "U" shaped, wherein the "U" has a flat center portion that engages an end face of the slots, and wherein the "U" has a side portion that extends along the upstream or downstream face of the sealing rail.

9. The rotor of claim 8, wherein the side portion of the "U" shaped damper element extends radially outward on the face of the sealing rail.

10. The rotor of claim 8, wherein the side portion of the "U" shaped damper element extends radially inward on the face of the sealing rail.

11. The rotor of claim 8, wherein a portion of the shroud has been relieved at a location near the damper element such that the damper element mates with a relieved portion of the shroud.

12. The rotor of claim 8, wherein one of the slots is undercut at an end face of the slot to further engage the damper element.

* * * * *